US010213834B2

(12) United States Patent
Vieyra Villegas et al.

(10) Patent No.: US 10,213,834 B2
(45) Date of Patent: Feb. 26, 2019

(54) METHOD OF FABRICATING AN ARTICLE FOR MAGNETIC HEAT EXCHANGER

(71) Applicant: Vacuumschmelze GmbH & Co. KG, Hanau (DE)

(72) Inventors: Hugo Abdiel Vieyra Villegas, Hanau (DE); Matthias Katter, Alzenau (DE); Barcza Alexander, Hanau (DE)

(73) Assignee: Vacuumschmelze GmbH & Co. KG, Hanau (DE)

( * ) Notice: Subject to any disclaimer, the term of this patent is extended or adjusted under 35 U.S.C. 154(b) by 267 days.

(21) Appl. No.: 15/171,516

(22) Filed: Jun. 2, 2016

(65) Prior Publication Data

US 2017/0050243 A1 Feb. 23, 2017

(30) Foreign Application Priority Data

Jun. 3, 2015 (GB) ..... 1509626.6

(51) Int. Cl.

| | |
|---|---|
| ***B22F 3/16*** | (2006.01) |
| ***H01F 41/00*** | (2006.01) |
| ***H01F 1/01*** | (2006.01) |
| ***B22F 3/10*** | (2006.01) |
| ***H01F 1/26*** | (2006.01) |

(52) U.S. Cl.

CPC ..... *B22F 3/16* (2013.01); *B22F 3/1007* (2013.01); *B22F 3/1021* (2013.01); *H01F 1/015* (2013.01); *H01F 1/017* (2013.01); *H01F 1/26* (2013.01); *H01F 41/00* (2013.01)

(58) Field of Classification Search

None

See application file for complete search history.

(56) References Cited

U.S. PATENT DOCUMENTS

| | | | | |
|---|---|---|---|---|
| 4,534,936 | A * | 8/1985 | Carlstrom | B22F 3/1021 419/36 |
| 4,766,947 | A * | 8/1988 | Shibuya | B22D 11/0694 164/460 |
| 5,028,277 | A * | 7/1991 | Mizoguchi | B22D 11/06 148/403 |
| 5,722,032 | A | 2/1998 | Gay | |
| 6,179,894 | B1 | 1/2001 | Gay | |
| 6,676,772 | B2 | 1/2004 | Saito et al. | |

(Continued)

FOREIGN PATENT DOCUMENTS

| | | |
|---|---|---|
| CN | 102189406 A | 9/2011 |
| CN | 103624491 A | 3/2014 |

(Continued)

OTHER PUBLICATIONS

Combined Search and Examination Report dated Apr. 12, 2016.
Combined Search and Examination Report dated Dec. 1, 2015.
Combined Search and Examination Report dated Dec. 7, 2015.

*Primary Examiner* — Jenny R Wu
(74) *Attorney, Agent, or Firm* — Dickinson Wright PLLC

(57) ABSTRACT

A method of fabricating an article for magnetic heat exchange, is provided which comprises plastically deforming a composite body comprising a binder having a glass transition temperature TG and a powder comprising a magnetocalorically active phase or elements in amounts suitable to produce a magnetocalorically active phase such that at least one dimension of the composite body' changes in length by at least 10%.

27 Claims, 9 Drawing Sheets

(56) References Cited

U.S. PATENT DOCUMENTS

| | | | | |
|---|---|---|---|---|
| 7,063,754 | B2 | 6/2006 | Fukamichi et al. | |
| 2006/0231163 | A1* | 10/2006 | Hirosawa | H01F 1/015 148/105 |
| 2007/0289717 | A1* | 12/2007 | Kroos | B22D 11/045 164/462 |
| 2010/0231433 | A1 | 9/2010 | Tishin et al. | |
| 2012/0033002 | A1 | 2/2012 | Seeler et al. | |
| 2012/0291453 | A1 | 11/2012 | Watanabe et al. | |
| 2013/0061602 | A1 | 3/2013 | Kuo et al. | |
| 2013/0187077 | A1* | 7/2013 | Katter | H01F 1/015 252/62.51 C |
| 2014/0023821 | A1* | 1/2014 | Kwon | H01F 1/012 428/116 |
| 2015/0037558 | A1* | 2/2015 | Dubrez | H01F 1/015 428/220 |

FOREIGN PATENT DOCUMENTS

| | | | |
|---|---|---|---|
| EP | 0663672 | A2 | 7/1995 |
| EP | 0870814 | A1 | 10/1998 |
| EP | 2636972 | A1 | 9/2013 |
| GB | 1076036 | A | 7/1967 |
| GB | 2490820 | A | 11/2012 |
| JP | H0719790 | A | 1/1995 |
| WO | 2010128357 | A1 | 11/2010 |
| WO | 2011053351 | A1 | 5/2011 |
| WO | 2015018705 | A1 | 2/2015 |

* cited by examiner

FIG. 3
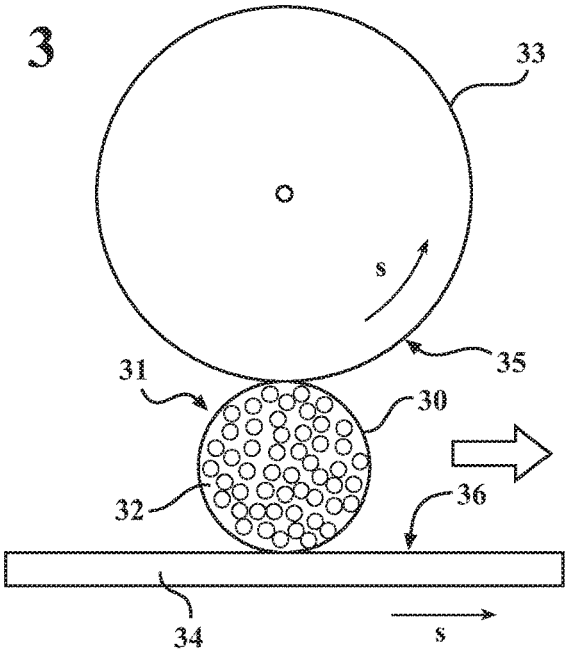
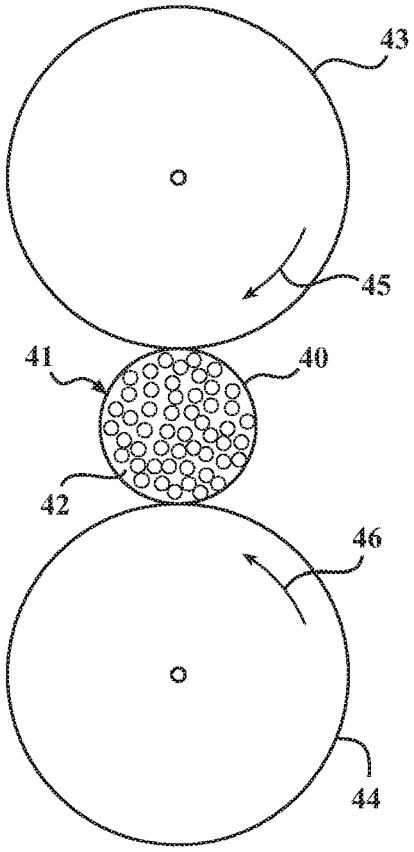
FIG. 4

METHOD OF FABRICATING AN ARTICLE FOR MAGNETIC HEAT EXCHANGER

This US patent application claims priority to GB patent application no. 1509626.6, filed 3 Jun. 2015, the entire content of which is incorporated herein by reference

BACKGROUND

1. Field

This invention relates to methods of fabricating a working component for magnetic heat exchange.

2. Related Art

Practical magnetic heat exchangers, such as that disclosed in U.S. Pat. No. 6,676,772 for example, may include a pumped recirculation system, a heat exchange medium such as a fluid coolant, a chamber packed with particles of a working material which displays the magnetocaloric effect and a means for applying a magnetic field to the chamber. The working material can be said to be magnetocalorically active.

The magnetocaloric effect describes the adiabatic conversion of a magnetically induced entropy change to the evolution or absorption of heat. Therefore, by applying a magnetic field to a magnetocalorically active working material, an entropy change can be induced which results in the evolution or absorption of heat. This effect can be harnessed to provide refrigeration and/or heating.

Magnetic heat exchangers are, in principle, more energy efficient than gas compression/expansion cycle systems. They are also considered environmentally friendly as chemicals such as hydrofluorocarbons (HFC) which are thought to contribute to the depletion of ozone levels are not used.

A variety of magnetocalorically active phases are known which have magnetic phase transition temperatures in a range suitable for providing domestic and commercial air conditioning and refrigeration. One such magnetocalorically active material, disclosed for example in U.S. Pat. No. 7,063,754, has a $NaZn_{13}$-type crystal structure and may be represented by the general formula $La(Fe_{1-x-y}T_yM_x)_{13}H_z$, where M is at least one element of the group consisting of Si and Al, and T may be one or more of transition metal elements such as Co, Ni, Mn and Cr. The magnetic phase transition temperature of this material may be adjusted by adjusting the composition.

In order to provide a practical magnetic heat exchanger, the magnetocalorically active material may be provided in the form of a practical working component. The working component may have the form of particles which are placed in a container or in the form of one or more plates or fins. Plate or fins may be produced by casting from a melt of the magnetocalorically active material or by sintering a compressed powder of the magnetocalorically active material.

However, further improvements for fabricating working components in practical forms for a magnetic heat exchanger which are cost effective and may be used on an industrial scale are desirable to enable a more extensive application of magnetic heat exchange technology.

SUMMARY

A method of fabricating an article for magnetic heat exchange is provided which comprises plastically deforming a composite body comprising a binder having a glass transition temperature TG and a powder comprising a magnetocalorically active phase or elements in amounts suitable to produce a magnetocalorically active phase such that at least one dimension of the composite body changes in length by at least 10%.

The composite body may include a powder comprising a magnetocalorically active phase or elements in amounts suitable to produce a magnetocalorically active phase. The powder including elements in amounts suitable to produce a magnetocalorically active phase may be magnetocalorically passive. The elements may be provided in form of elemental powders or powders comprising alloys of two or more of the elements. The elements may also be provided in the form of precursor powders. For example, oxides, nitrides or hydrides of the elements may be mixed in suitable amounts to provide the elements of the magnetocalorically active phase in the desired stoichiometry.

A magnetocalorically active material is defined herein as a material which undergoes a change in entropy when it is subjected to a magnetic field. The entropy change may be the result of a change from ferromagnetic to paramagnetic behavior, for example. The magnetocalorically active material may exhibit, in only a part of a temperature region, an inflection point at which the sign of the second derivative of magnetization with respect to an applied magnetic field changes from positive to negative.

A magnetocalorically passive material is defined herein as a material which exhibits no significant change in entropy when it is subjected to a magnetic field.

Examples of magnetocalorically active phases which may be used in the methods described herein are $Gd_5(Si,Ge)_4$, Mn(As, Sb), MnFe(P,Si,As) and $La_{1-a}R_a(Fe_{1-x-y}T_yM_x)13$.

The powder is mixed with the binder such that a composite body is formed which is plastically deformable due at least in part to the presence of the binder. The glass transition temperature TG of the binder enables the composite body to be plastically deformed at temperatures above TG, since above the glass transition temperature, the binder is in the glassy form, no longer brittle and consequently plastically deformable.

Plastic deformation describes a permanent change in shape of a solid body without fracture upon the action of a sustained force. Plastically deformable describes a material which is capable of undergoing plastic deformation. Plastically deforming describes the act of producing a permanent change in shape of a solid body without fracture upon applying a sustained force.

The method enables powder metallurgical production techniques to be used to produce a solid working component having a desired size and outer contour by plastically deforming the composite body. For example, a composite body in the form of a cube may be plastically deformed to produce a sheet or ribbon. The method may be used to fabricate articles with a near net shape so that loss of material, for example by singulating a large article into smaller articles, is reduced.

The composite body is plastically deformed such that at least one dimension of the composite body changes in length by at least 10%. For example, the composite body may have an initial length $d_1$. After plastic deformation the length may be $d_2$, whereby $d_2 \geq d_1+(10/100)d_1$ or $d_2 \leq d_1-(10/100)d_1$. In some embodiments, the composite body is plastically deformed such that at least one dimension of the composite body changes in length by at least 25%, i.e. $d_2 \geq d_1+(10/100)d_1$, or such that an increase in one dimension of at least 100%, i.e. $d_2 \geq 2 \times d_1$, is produced.

The composite body may be subsequently treated to remove the binder and to sinter the magnetocalorically active powder to increase the mechanical integrity of the working component. In embodiments, in which the composite body includes elements in amounts suitable to produce a magnetocalorically active phase, the binder may be removed and these elements or precursors including the elements may be reactively sintered to produce the magnetocalorically active phase and increase the mechanical integrity of the working component.

The term "reactive sintered" describes an article in which grains are joined to congruent grains by a reactive sintered bond. A reactive sintered bond is produced by heat treating a mixture of differing elements, for example precursor powders of differing compositions. The particles of different compositions chemically react with one another during the reactive sintering process to form the desired end phase or product. The composition of the particles, therefore, changes as a result of the heat treatment. The phase formation process also causes the particles to join together to form a sintered body having mechanical integrity.

Reactive sintering differs from conventional sintering. In conventional sintering, the particles consist of the desired end phase before the sintering process. The conventional sintering process causes a diffusion of atoms between neighbouring particles so as to join the particles to one another. The composition of the particles, therefore, remains unaltered as a result of a conventional sintering process. In reactive sintering, the end phase is produced by chemical reaction directly from a mixture of precursor powders of differing composition.

The powder metallurgical method according to one or more of the embodiments described herein may be used to produce a sintered article or a reactive sintered article for magnetic heat exchange which includes a magnetocalorically active phase with a $NaZn_{13}$-type crystal structure. $La_{1-a}R_a(Fe_{1-x-y}T_yM_x)_{13}H_zC_b$ is an example of a magnetocalorically active phase with a NaZn13-type structure, wherein M is Si and, optionally, Al, T is one or more of the elements from the group consisting of Mn, Co, Ni, Ti, V and Cr and R is one or more of the elements from the group consisting of Ce, Nd, Y and Pr, wherein $0 \le a \le 0.5$, $0.05 \le x \le 0.2$, $0.003 \le y \le 0.2$, $0 \le z \le 3$ and $0 \le b \le 1.5$.

Before plastic deformation, the composite body may be mechanically formed by injection molding, extrusion, screen printing, foil casting, three-dimensional screen printing, fluidized bed granulisation or calendaring, for example.

In some embodiments, the composite body is plastically deformed by extrusion to form a rod, followed by singulation of the rod to form a plurality of brown bodies having edges which are plastically deformed resulting in rounding of the plurality of brown bodies.

In some embodiments, the composite body is plastically deformed such that an elongated form is produced having a first dimension that is at least 1.5 times greater than a second dimension. After plastic deformation the composite body may have a first dimension $d_1$ which is at least 1.5 times a second dimension $d_2$, i.e. $d_1 > 1.5 \times dz$. In some embodiments, the composite body is plastically deformed such that an elongated form is produced having a first dimension that is at least 3 times greater than a second dimension, i.e. $d_1 > 3 \times d_2$.

For example, the composite body may initially have a rod form with a substantially circular cross-section and the composite body may be plastically deformed, for example by extrusion, such that the length of the rod increases and the diameter of the circular cross-section decreases such that the length is at least 1.5 times greater than the diameter. In another example, the composite body may initially have a rod form with a rectangular cross-section. The composite body may be plastically deformed, for example by rolling, such that the length is at least 1.5 times the longest length of the rectangular cross-section. In another example, a substantially spherical composite body may be rolled to form an ellipsoid.

In a further embodiment, the composite body is plastically deformed such that a substantially ellipsoid form is produced having a long axis that is at least 1.5 times greater than a shortest axis or at least 3 times greater than a shortest axis.

An ellipsoid is a closed quadric surface that is a three-dimensional analogue of an ellipse. The standard equation of an ellipsoid centered at the origin of a Cartesian coordinate system and aligned with the axes is $$\frac{x^2}{a^2} + \frac{y^2}{b^2} + \frac{z^2}{c^2} = 1$$

The points (a,0,0), (0,b,0) and (0,0,c) lie on the surface and the line segments from the origin to these points are called the semi-principal axes of length a, b, c. They correspond to the semi-major axis and semi-minor axis of the appropriate ellipses.

There are four distinct cases of which one is degenerate: triaxial ellipsoid, whereby a>b>c; oblate ellipsoid of revolution, whereby a=b>c; prolate ellipsoid of revolution, whereby a=b<c; the degenerate case of a sphere in which a=b=c.

The plastically deforming the composite body may comprise plastically deforming the composite body at a temperature T which is above the glass transition temperature TG of the binder. In some embodiments, T>TG+20K. If TG is around 40° C., T may be 60° C. to 80° C. In some embodiments, T may lie in the range of 50° C. to 80° C. The temperature of the composite body during plastic deformation is less than the decomposition temperature of the binder.

In embodiments in which the glass transition temperature of the binder is around or above room temperature, the temperature of the composite body may be increased to above the glass transition temperature of the binder whilst being plastically deformed. The temperature of the composite body during plastic deformation may be adjusted depending on the increase in the dimension which is desired after plastic deformation. For example the temperature may be increased to achieve higher degrees of plastic deformation of the initial composite body.

The temperature of at least the surfaces of apparatus contacting the composite body during plastic deformation may be adjusted such that the temperature of the surfaces is above the glass transition temperature of the binder in order to avoid cooling the composite body to a temperature below the glass transition temperature or below the desired temperature at which plastic deformation is to take place. The temperature of at least the surfaces of apparatus contacting the composite body during plastic deformation may be adjusted such that the temperature of the composite body is increased to a temperature above the glass transition temperature of the binder.

In some embodiments, the plastically deforming the composite body comprises plastically deforming the composite body by rolling. Different types of rolling techniques may be used. For example, hot rolling may be used in order that the plastic deformation of the composite body by rolling takes place above the glass transition temperature of the binder of the composite body.

In some embodiments, the rolling comprises passing the composite body between two rolls rotating in opposing directions. In some embodiments, the rolling comprises passing the composite body between two rolls rotating with differing speeds. This method may be used to produce an ellipsoid body having three axes of differing length from a composite body having an initially substantially spherical form.

The plastically deforming of the composite body may comprise pressing a roller against a band, the surfaces of the roller and the band may move at substantially the same speed or differing speeds. If the band and the roller move at substantially the same speed, the method may be used to produce an ellipsoid body having three axes of differing length, for example a form similar to a lentil, from a composite body having an initially substantially spherical form. If the band and the roller move at differing speeds, the method may be used to produce an ellipsoid body having three axes of differing length, for example a form similar to a grain of rice, from a composite body having an initially substantially spherical form.

A composite body having an elliptical outer contour and substantially constant thickness may be produced by rolling or pressing a substantially spherical composite body.

In some embodiments, the composite body has a form with sharp edges, for example a substantially cylindrical shape, and the plastically deforming the composite body comprises treating the composite body in a spheronizer. This method may be used to produce ellipsoid or substantially spherical composite bodies from elongate forms.

The plastically deforming the composite body may be performed in an inert atmosphere, for example under nitrogen or argon gas. The equipment used to perform the plastic deformation may be placed in a glovebox with an inert atmosphere, for example.

The binder may have differing compositions. In an embodiment, the binder comprises a decomposition temperature of less than 300° C., preferably less than 200° C. This assists in the removal of the binder from the mixture to form the green body.

The binder may be selected to avoid undesirable chemical reactions with the magnetocalorically active phase or elements or precursors of the magnetocalorically active phase and/or to reduce the uptake of elements from the binder, for example carbon and/or oxygen into the magnetocalorically active phase which may affect the magnetocaloric properties.

In some embodiments, the binder may be a poly (alkylene carbonate). The poly (alkylene carbonate) may comprise one of the group consisting of poly (ethylene carbonate), poly (propylene carbonate), poly (butylene carbonate) and poly (cyclohexene carbonate). If poly (propylene carbonate) is used, it may have a relative molecular mass of 13,000 to 350,000, preferably 90,000 to 350,000.

The use of a binder comprising a poly (alkylene carbonate) enables the production of a finished sintered article with a low carbon and oxygen content, since poly (alkylene carbonate) binders may be removed without leaving residues or components of a reaction with the elements of the magnetocalorically active phase. Poly (alkylene carbonate) binders are found to be particularly suitable for use with the $La_{1-a}R_a(Fe_{1-x-y}T_yM_x)_{13}H_zC_b$ magnetocalorically active phase.

The binder to powder ratio may be adjusted. In some embodiments, the mixture comprises 0.1 weight percent to 10 weight percent binder, preferably 0.5 weight percent to 4 weight percent binder. A higher binder content may be used to increase the mechanical stability of the composite body. The composite body may also be considered to be a brown body.

The binder may be removed by heat treating the composite body at a temperature of less than 400° C. The heat treating may be carried out in a noble gas atmosphere, a hydrogen-containing atmosphere or under vacuum or a combination of these. The heat treatment may be carried out for 30 min to 20 hours, preferably, 2 hours to 6 hours. The composite body may be heat treated under conditions such that at least 90% by weight of the binder, preferably more than 95 weight percent, is removed.

In some embodiments, the method comprises mixing a solvent with the binder and the powder to form a mixture from which a precursor article is formed. In these embodiments, the solvent may then be removed from the precursor article to form the composite body. The solvent may be removed by drying the precursor article, for example the precursor article may be dried by heat treating the precursor article at a temperature of less than 100° C. under vacuum. The precursor article may be dried by placing the precursor article in a chamber and evacuating the chamber.

The solvent may comprise one of the group consisting of 2,2,4-trimethylpentane (isooctane), isopropanol, 3-methoxy-1-butanol, propylacetate, dimethyl carbonate and methylethylketone. In some embodiments, the binder is poly (propylene carbonate) and the solvent is methyl ethylketone.

After plastic deformation of the composite body, the composite body may be sintered by heat treating at a temperature between 900° C. and 1200° C., preferably, between 1050° C. and 1150° C. in a noble gas, a hydrogen-containing atmosphere and/or under vacuum.

A sequence of differing atmospheres may be used during sintering. In an embodiment, the sintering is carried out for a total sintering time $t_{tot}$. The green body is initially sintered in vacuum for $0.95t_{tot}$ to $0.75t_{tot}$ and subsequently in a noble gas or hydrogen-containing atmosphere for $0.05t_{tot}$ to $0.25t_{tot}$.

The magnetocalorically active phase may be $La_{1-a}R_a(Fe_{1-x-y}T_yM_x)_{13}H_zC_b$, wherein M is Si and, optionally, Al, T is one or more of the elements from the group consisting of Mn, Co, Ni, Ti, V and Cr and R is one or more of the elements from the group consisting of Ce, Nd, Y and Pr, wherein $0 \le a \le 0.5$, $0.05 \le x \le 0.2$, $0.003 \le y \le 0.2$, $0 \le z \le 3$ and $0 \le b \le 1.5$. In embodiments in which the $La_{1-a}R_a(Fe_{1-x-y}T_yM_x)_{13}H_zC_b$ phase includes one or more of the elements denoted by R, the content may be $0.005 \le a \le 0.5$. In embodiments in which the $La_{1-a}R_a(Fe_{1-x-y}T_yM_x)_{13}H_zC_b$ phase includes hydrogen, the hydrogen content z may be $1.2 \le z \le 3$. If hydrogen is present, it is incorporated interstitially within the $NaZn_{13}$ structure of the $La_{1-a}R_a(Fe_{1-x-y}T_yM_x)_{13}H_zC_b$ phase.

After sintering or reactive sintering, the working component may be subjected to a further hydrogenation treatment to introduce hydrogen into the $NaZn_{13}$ structure.

BRIEF DESCRIPTION OF THE DRAWINGS

Embodiments and examples will now be described with reference to the drawings and tables.

FIG. 3 illustrates a schematic diagram of plastically deforming a substantially spherical composite body between a roller and a band.

FIG. 4 illustrates a schematic diagram of plastically deforming a substantially spherical composite body between two rollers rotating in opposing directions.

DETAILED DESCRIPTION OF EXAMPLE EMBODIMENTS

Figure 1:
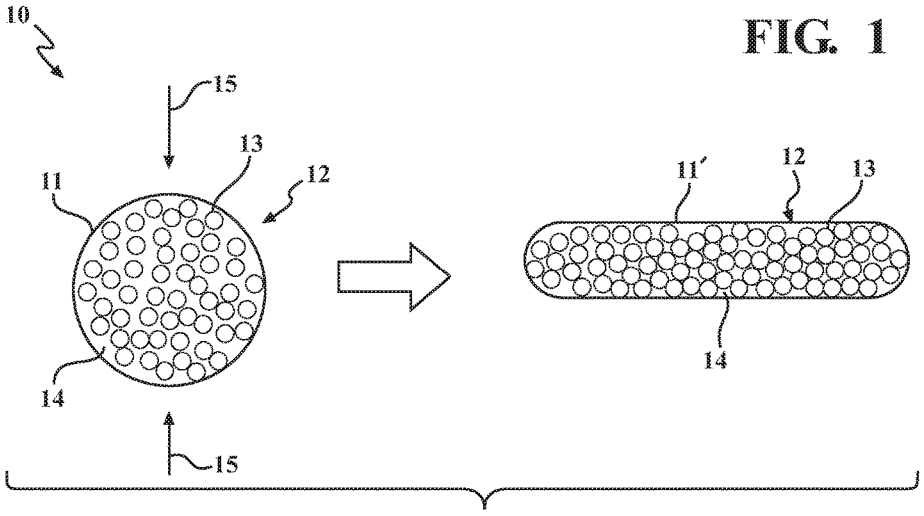
FIG. 1 illustrates a schematic diagram of a method of fabricating an article for magnetic heat exchange by plastically deforming a composite body.

FIG. 1 illustrates a schematic diagram of a method 10 of fabricating an article for magnetic heat exchange by plastically deforming a composite body 11. The composite body 11 includes a powder 12 including a plurality of particles 13 and a binder 14. The binder 14 may bridge gaps between the particles 13. The binder 14 has a glass transition temperature TG such that the composite body 11 may be plastically deformed at temperatures above TG, for example at temperatures of around 20 to 30K higher than TG. The plastic deformation of the composite body 11 is schematic indicated with the arrows 15. After plastic deformation the composite body 11' has a different shape. For example, a composite body 11 having a spherical form may be plastically deformed to produce an ellipsoid 11' having three axes of differing length or an ellipsoid 11' having two axes of the same-length and a third axis which is longer or shorter than other two ones.

Elongate forms including ellipsoid forms are useful for working components of a magnetic heat exchanger since they can be arranged such that the longer axis or dimension is substantially parallel to the direction of the flow of the coolant and the shortest axis is substantially perpendicular to the direction of flow of coolant. This arrangement reduces turbulence in the coolant flow and increases heat exchange between the working component and the heat transfer fluid.

The composite body may be plastically deformed using different techniques. In some embodiments, the composite body is plastically deformed such that at least one dimension of the composite body changes in length by at least 10%. For example the length of a rod shaped composite body may increase by at least 10% or the diameter of the rod-shaped composite body may decrease by at least 10%.

Figure 2:
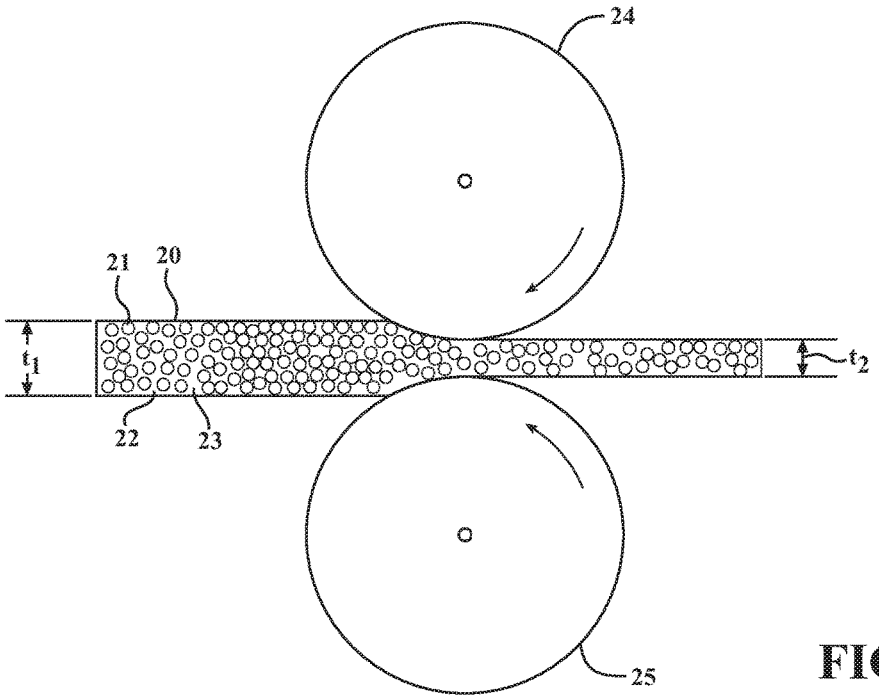
FIG. 2 illustrates a schematic diagram of plastically deforming an elongate composite body by rolling.

FIG. 2 illustrates a schematic diagram of plastically deforming an elongate composite body 20 by rolling. The composite body 20 includes a plurality of particles 21 of a powder embedded in a matrix 22 comprising a binder 23. The composite body 20 has a rod-like shape and may have a square, rectangular, circular or elliptical cross-section. The composite body 20 is passed between two rollers 24, 25 rotating in opposing directions, plastically deforming the composite body 20 such that the length of the composite body is increased from 11 to 12 and the thickness is decreased from $t_1$ to $t_2$.

FIG. 3 illustrates a schematic diagram of plastically deforming a substantially spherical composite body 30 including a powder 31 and a binder 32 between a roller 33 and a band 34 which each have a surface 35, 36 which is moving at the same speed s. This arrangement may be used to produce an ellipsoid composite body with three axes of differing length. The shape produced may be thought of as similar to the shape of a convex lens.

FIG. 4 illustrates a schematic diagram of plastically deforming a substantially spherical composite body 40 including a powder 41 and binder 42 between two rollers 43, 44, rotating in opposing directions as is indicated schematically by the arrows 45, 46. In the case these two speeds are different, the shape produced may be thought of as similar to the shape of a grain of rice.

Figure 5:
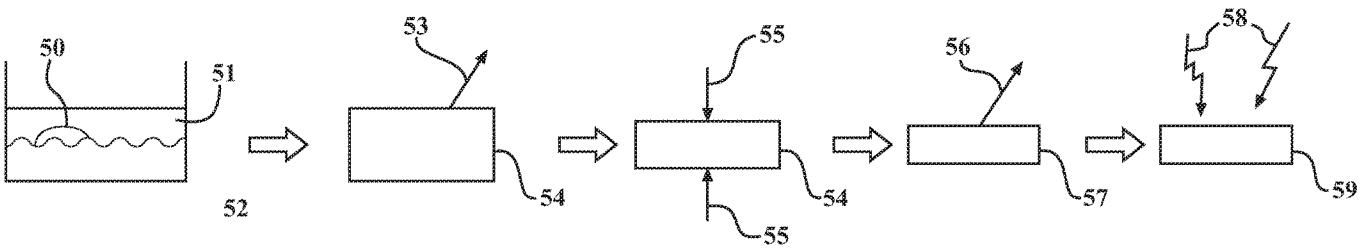
FIG. 5 illustrates a schematic diagram of a method of fabricating an article for magnetic heat exchange.

FIG. 5 illustrates a schematic diagram of a method of fabricating an article for magnetic heat exchange, in particular, an article which may be used as, or as part of, a working component of a magnetic heat exchanger.

The composite body may be fabricated by mixing a binder 50 and a solvent 51 with a powder 52 comprising a magnetocalorically active phase with a $NaZn_{13}$-type crystal structure. In some embodiments, the powder may comprise a composition suitable to form a magnetocalorically active phase after reactive sintering. The binder 50 may comprise a poly (alkylene carbonate), for example poly (ethylene carbonate), poly (propylene carbonate), poly (butylene carbonate) or poly (cyclohexene carbonate). The solvent 51 may comprise 2,2,4-Trimethylpentane, isopropanol, 3 Methoxy-1-butanol, propylacetate, dimethyl carbonate or methylethylketone. The magnetocalorically active phase may be $La_{1-a}R_a(Fe_{1-x-y}T_yM_x)_{13}H_zC_b$, wherein M is Si and, optionally, Al, T is one or more of the elements from the group consisting of Mn, Co, Ni, Ti, V and Cr and R is one or more of the elements from the group consisting of Ce, Nd, Y and Pr, wherein $0 \le a \le 0.5$, $0.05 \le x \le 0.2$, $0.003 \le y \le 0.2$, $0 \le z \le 3$ and $0 \le b \le 1.5$.

In one embodiment, the binder 50 is poly (propylene carbonate) and the solvent 51 is methylethylketone. These compositions of the binder 50 and solvent 51 are found to be suitable for the $La_{1-a}R_a(Fe_{1-x-y}T_yM_x)_{13}H_zC_b$ phase, since they can be removed from powder including this phase leaving an acceptably low residual carbon and oxygen content.

Around 0.1% weight percent to 10 weight percent, preferably 0.5 weight percent to 4 weight percent of binder 50 may be added to the powder 52.

The mixture of the binder 50, solvent 51 and powder 52 including a magnetocalorically active phase with a $NaZn_{13}$-type crystal structure may be further processed by removing some or substantially all of the solvent 51 as is indicated schematically with the arrow 53 to form a composite body 54. The composite body 54 may be termed a brown body which includes the powder 52 and the binder 50. The composite body 54 may be plastically deformed to change its shape as is schematically indicated with the arrow 55. The composite body 54 may be plastically deformed by rolling.

In some embodiments, the composite body 54 may have the form of a granule which is substantially spherical. Granules may be formed by fluidized bed granulisation. In some embodiments, the composite body 54 may be mechanically formed by extruding the composite body 54 to form a rod, singulating the rod to form a plurality of composite bodies and rounding at least the edges of the plurality of composite bodies.

The binder 50 may then be removed from the composite body 54, as is indicated schematically in FIG. 1 by the arrow 56, to produce a green body 57. The green body 57 may then be sintered, as is schematically indicated in FIG. 1 by arrows 58, to produce an article 59 for magnetic heat exchange.

The binder 50 may be removed by heat treating the composite body 54 at a temperature of less than 400° C. in a noble gas atmosphere, a hydrogen containing atmosphere, under vacuum or a combination of these for a period of around 30 min to 20 hours, preferably 2 to 6 hours. Preferably, the conditions are selected such that at least 90% by weight or 95% by weight of the binder 50 is removed.

The green body 57 may be sintered at a temperature between 900° C. and 1200° C. in a noble gas atmosphere, a hydrogen containing atmosphere or under vacuum or a combination of these, if the composite body 54 and green body 57 includes the magnetocalorically active phase. If the composite body 54 and the green body 57 include elements suitable for forming the magnetocalorically active phase, i.e. precursors which are magneto-calorically passive, the green body may be reactive sintered to form the magnetocalorically active phase from the elements or precursors.

The binder and the treatment for its removal from the composite body may be selected so as to avoid detrimentally affecting the magnetocaloric properties of the working component.

The suitability of different binders for $La_{1-a}R_a(Fe_{1-x-y}T_yM_x)_{13}H_zC_b$ is investigated. The binders polyvinylpyrrolidone (PVP), polyvinylbutyral (PVB) and polypropylene carbonate (PPC) are investigated. Samples are made using 0.1, 0.5, 1 and 2 weight percent binder (related to the powder), around 40 g of powder and 20 g of solvent. For PVP and PVB, isopropanol is used as a solvent and for PPC, methylethylketone (MEK) is used as the solvent. The mixtures were in each case mixed for 30 minutes in a turbula mixer and dried at 70° C. for 14 hours under vacuum.

Figure 6B:
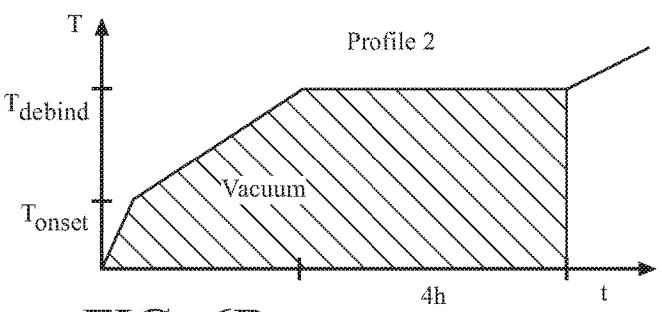
FIGS. 6A-6C illustrate three differing debinding heat treatment profiles.
Figure 6A:
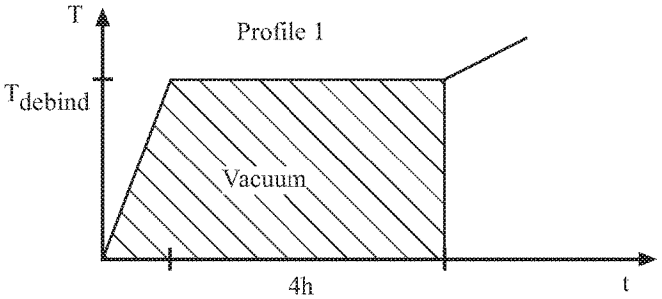
Figure 6C:
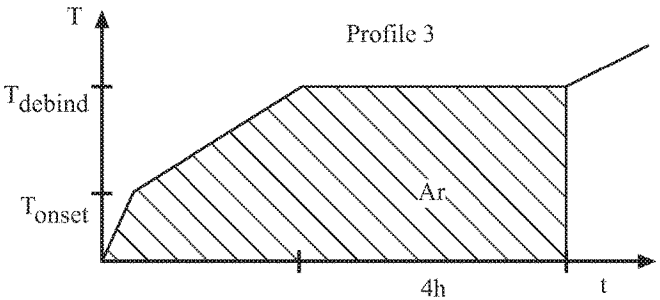

FIG. 6 illustrates three types of heat treatment for removing the binder or debinding. In heat treatment 1, the debinding was carried out under vacuum using a constant heating rate to the debinding temperature $T_{debind}$ which was held for four hours. The heating rate is variable between 2° C. per minute and 4° C. per minute. For the second debinding heat treatment, slower heating rates were used. In a first step, sample was heated at around 3° C. per minute to a first temperature $T_{onset}$, then the heating rate was slowed to around 0.5 to 1° C. per minute from $T_{onset}$ to the debinding temperature $T_{debind}$ which was held for 4 hours. The second debinding treatment was also carried out in vacuum.

The third debinding heat treatment uses the same heat treatment profile as the second debinding treatment. However, after reaching the temperature $T_{onset}$, the vacuum is replaced by 1300 mbar argon.

After the debinding treatment, the samples are sintered by heating from the debinding temperature to the sinter temperature in 7 hours under vacuum, held at the sintering temperature for 3 hours, the atmosphere changed to argon and the sample held at the sintering temperature for further 1 hour in argon. A further homogenisation heat treatment at 1050° C. for 4 hours in argon is used and the samples cooled quickly to room temperature using compressed air.

Figure 7A:
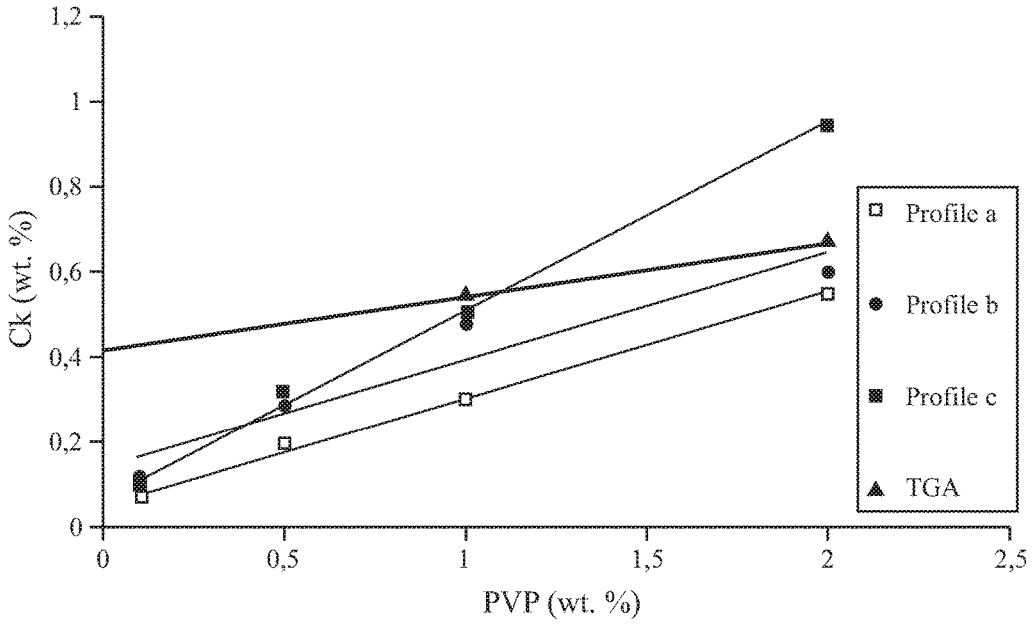
FIGS. 7A and 7B illustrate graphs of carbon and oxygen uptake for samples after debinding a PVP binder.
Figure 7B:
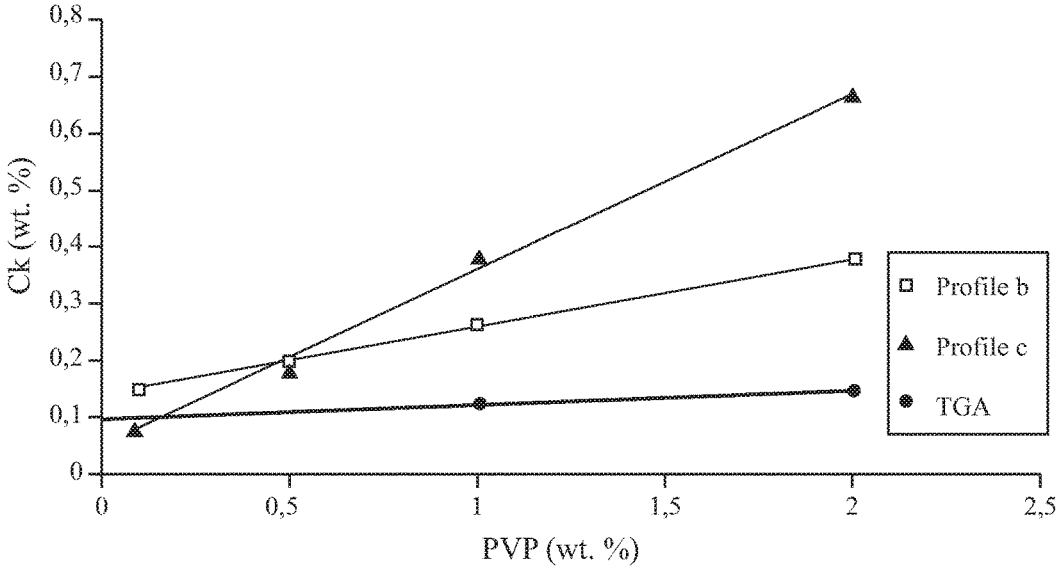

FIG. 7 illustrates the carbon uptake and oxygen uptake measured for samples mixed with PVP after the three debinding heat treatments. Values obtained using thermogravimetric analysis (TGA) in nitrogen are included as a comparison. The debinding temperature $T_{debind}$ is 460° C. and $T_{onset}$ is 320° C. The debinding treatments carried out entirely under vacuum, that is debinding heat treatments 1 and 2, result in a lower level of increase in carbon than under nitrogen, as is indicated by TGA comparison values illustrated in FIG. 7. The debinding treatment 1 results in the lowest increase in the carbon contents. However, the debinding treatments carried out entirely under vacuum, that is debinding heat treatments 1 and 2, result in a higher level of increase in oxygen than under nitrogen, as is indicated by TGA comparison values illustrated in FIG. 7.

Figure 8A:
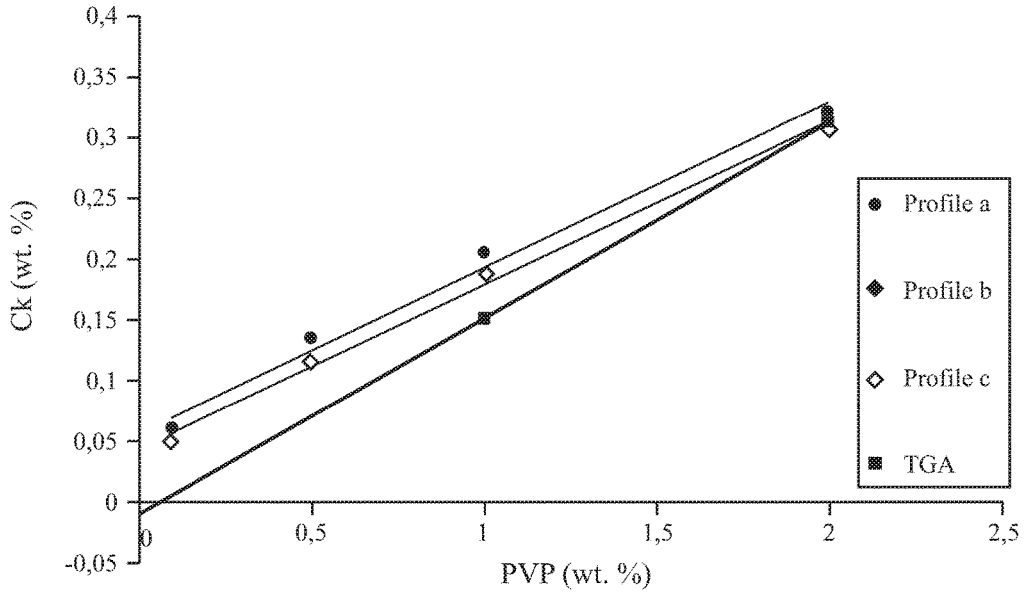
FIGS. 8A and 8B illustrate graphs of carbon and oxygen uptake for samples after debinding a PVB binder.
Figure 8B:
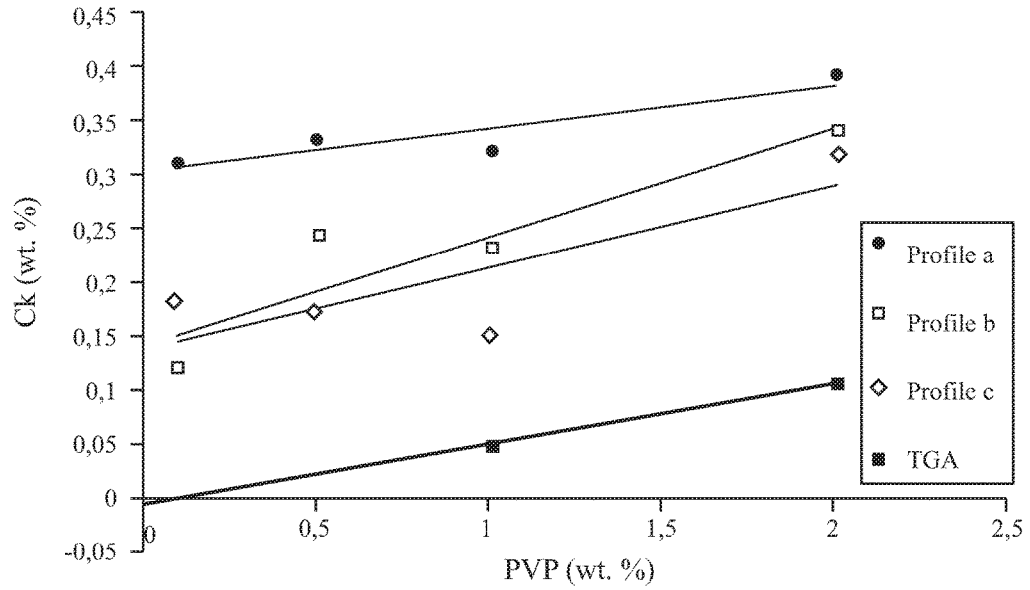

FIG. 8 illustrates the carbon uptake and oxygen uptake measured from samples mixed with PVB after use of each of the three debinding treatments. The debinding temperature $T_{debind}$ is 400° C. and $T_{onset}$ is 200° C. The use of a PVB binder results in an increase in the carbon content of around 0.3 weight percent and an increase in the oxygen content of around 0.3 weight percent for a binder amount of 2 weight percent. The uptake of carbon and oxygen for PVB is lower compared to PVP. However, about 30% of the binder remains in the final sintered product which may affect the magnetocaloric properties of the material.

Figure 9A:
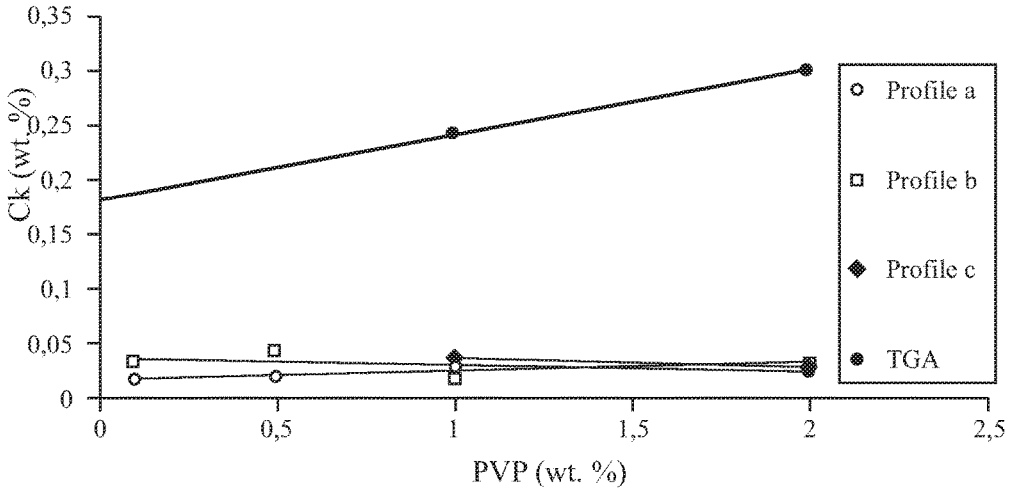
FIGS. 9A and 9B illustrate graphs of carbon and oxygen uptake for samples after debinding a PPC binder.
Figure 9B:
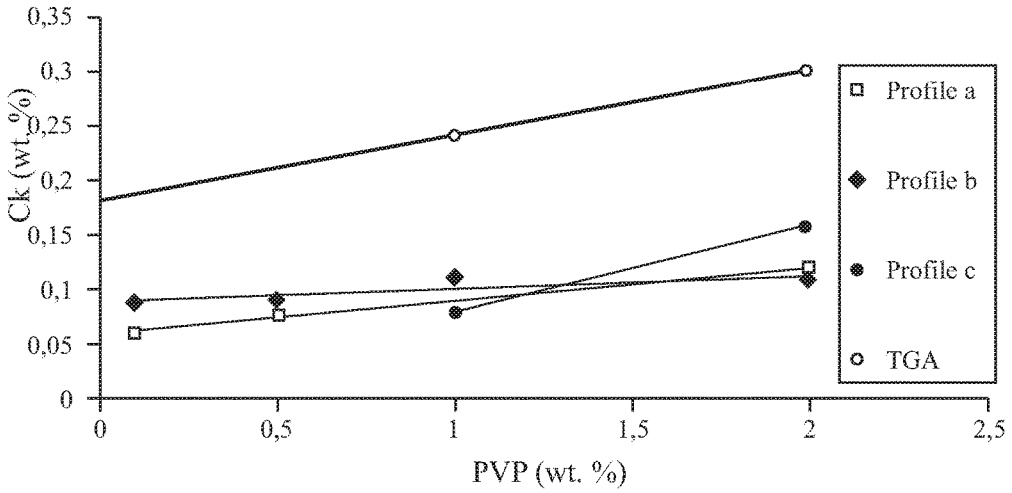

FIG. 9 illustrates a graph of the carbon uptake and oxygen uptake as function of weight percent of PPC binder for samples given each of the three debinding heat treatments. The debinding temperature is 300° C. and $T_{onset}$ is 100° C. The carbon uptake in the samples after the debinding treatment is much lower than the TGA values for each of the three debinding heat treatments and it is also much lower compared to PVP and PVB. Also the oxygen uptake is lower than the TGA values for each of the three debinding heat treatments and it is also lower compared to PVP and PVB.

The carbon uptake and oxygen uptake after the three debinding treatments are summarized in table 1.

TABLE 1

| | PVP | PVB | PPC |
|---|---|---|---|
| Density (mean value) | 5.99 g/cm$^3$ | 6.70 g/cm$^3$ | 6.72 g/cm$^3$ |
| Preferred debinding atmosphere | Vacuum | Vacuum or Argon | Vacuum or Argon |
| Preferred debinding profile | Profile 1 | Profile 2/Profile 3 | Profile 1 |
| $C_x$ | (0.25*PVP + 0.06) wt. % | (0.135*PVB + 0.045) wt. % | (0.0106*PPC + 0.0153) wt. % |
| $O_x$ | (0.12*PVP + 0.138) wt. % | (0.10*PVB + 0.14) wt. % | (0.0273*PPC + 0.0599) wt. % |
| Compatibility with LaFeSi | Low | Medium | very high |

In summary, PPC is a particular suitable binder for the $La_{1-a}R_a$ $(Fe_{1-x-y}T_yM_x)_{13}H_zC_b$ phase since the increase in carbon and oxygen after the debinding treatment is lowest for the three binders investigated.

As discussed above, the mixture of the powder, the binder and solvent may be mechanically formed before removal of solvent, for example by casting or screen printing, or after removal of some or substantially all of the solvent by methods such as extrusion or calendaring of the brown body. In some embodiments, spherical granulates or granules are useful for use in the working component of a magnetic heat exchanger. In some embodiments, the granules including particles of the powder and a binder are plastically deformed, before a subsequent debinding and sintering or reactive sintering treatments.

Figure 10:
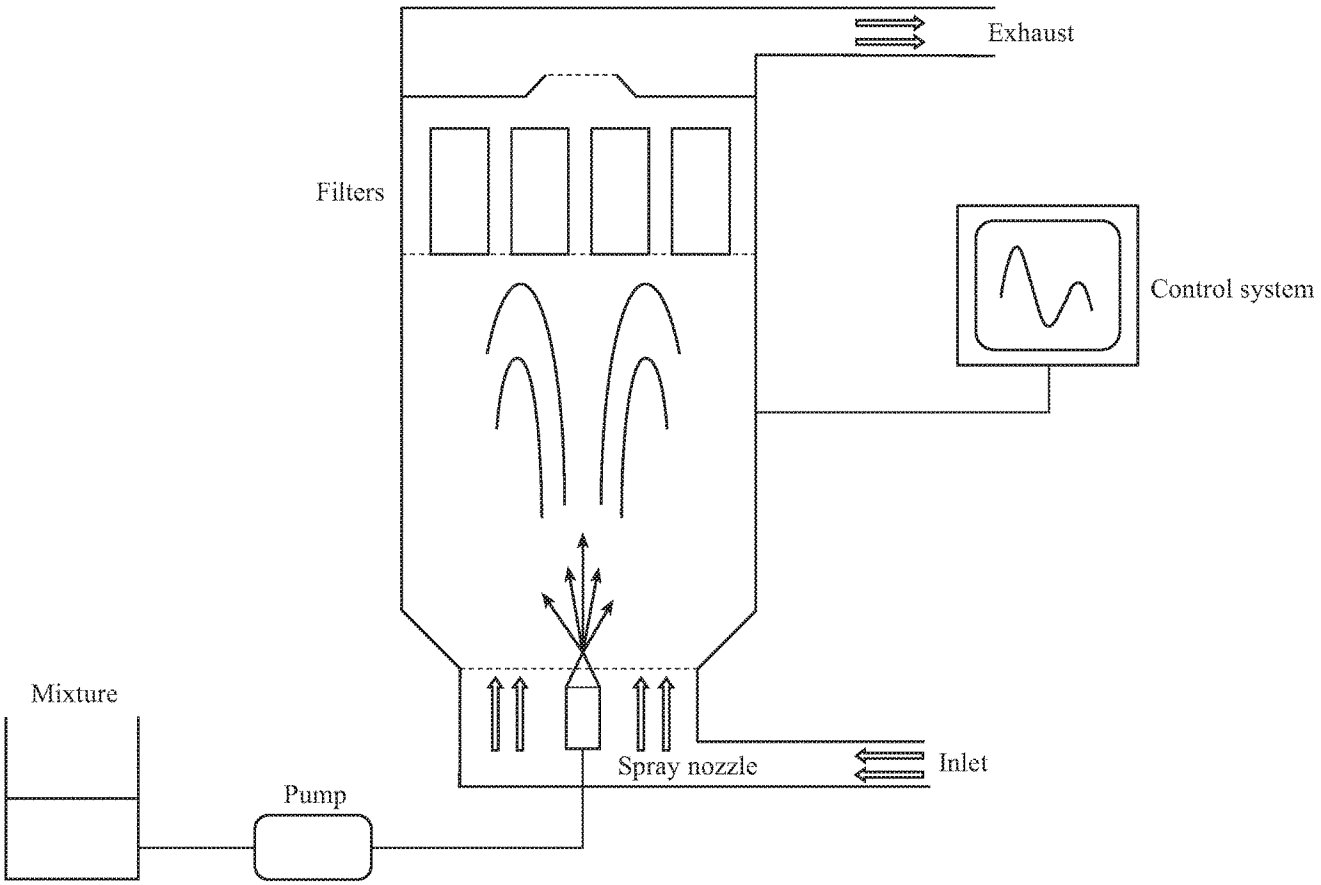
FIG. 10 illustrates a schematic diagram of apparatus for fluidized bed granulisation.

In some embodiments, the spherical or substantially spherical granules may be made using fluidized bed granualisation. FIG. 10 illustrates apparatus for fluidized bed granualisation.

In the fluidized bed granulisation method, powder including the magnetocalorically active phase or precursors thereof or elements in amounts suitable to produce a magnetocalorically active phase is caused to circulate by application of a gas and a fluid, such as a suitable solvent or a mixture of a suitable solvent and a suitable binder, is sprayed into the moving particles to create the granules. The binder may be added to form stable granules. As discussed above, PPC and methylethylketone is a combination of binder and solvent which is suitable for the $La_{1-a}R_a$ $(Fe_{1-x-y}T_yM_x)_{13}$ $H_zC_b$ phase. The gas temperature, pressure and speed may be adjusted to adjust the size of the granules formed.

Conditions suitable for fabricating the granules using fluidized bed granulisation are summarized in table 2.

TABLE 2

| Parameter | Value |
|---|---|
| Starting material | 200 g powder (<315 μm) or granules (<400 μm) |
| Binder | 2 wt. % PPC |
| Suspension | 60 wt. % LaFeSi, 40 wt. % MEK |
| Gas flow | 13 $m^3/h$ |
| Temperature | 45° C. |
| Spraying rate | 29 g/min |
| Spraying pressure | 1.5 bar |
| Purging pressure | 2 bar |

The nominal compositions of the powder in weight percentage summarized in table 3.

TABLE 3

| Charge | SE | Si | La | Co | Mn | C | O | N | Fe |
|---|---|---|---|---|---|---|---|---|---|
| MFP-1384 | 17.86 | 4.13 | 17.85 | 0.09 | 1.84 | 0.015 | 0.31 | 0.025 | 75.73 |
| MFP-1385 | 17.82 | 4.12 | 17.81 | 0.1 | 1.65 | 0.015 | 0.3 | 0.024 | 75.96 |
| MFP-1386 | 17.78 | 4.09 | 17.77 | 0.11 | 1.47 | 0.015 | 0.3 | 0.023 | 76.21 |

For each powder, three runs in the fluidized bed granulisation 'apparatus were performed. In run 1, the binder containing material is used as the starting material. In run 2, granules with a diameter of less than 400 μm obtained from run 1 are mixed with fine powder from the filter and used as the starting powder. In run 3, granules with a diameter less than 400 μm obtained from run 2 are mixed with fine powder from the filter and used as starting material.

The results are summarised in table 4.

TABLE 4

| | 1384 Run 1 | 1384 Run 2 | 1384 Run 3 | 1385 Run 1 | 1385 Run 2 | 1385 Run 3 | 1386 Run 1 | 1386 Run 2 | 1386 Run 3 |
|---|---|---|---|---|---|---|---|---|---|
| Sprayed material | 761 g | 487 g | 405 g | 911 g | 515 g | 679 g | 757 g | 653 g | 468 g |
| Starting material | 230 g | 200 g | 200 g | 80 g | 200 g | 200 g | 200 g | 200 g | 200 g |
| Fraction <400 μm | 113 g | 62 g | 72 g | 17 g | 7 g | 33 g | 95 g | 97 g | 24 g |
| Fraction 400-630 μm | 210 g | 298 g | 133 g | 71 g | 34 g | 23 g | 133 g | 242 g | 90 g |
| Fraction >630 μm | 82 g | 8 g | 31 g | 372 g | 210 g | 243 g | 248 g | 88 g | 1 g |
| Yield | ~41% | ~53% | ~39% | ~46% | ~35% | ~34% | ~49% | ~50% | ~17% |
| Filter powder | 585 g | 318 g | 369 g | 530 g | 462 g | 580 g | 480 g | 425 g | 551 g |

The granules fabricated by fluidized bed granulisation are subjected to a debinding heat treatment and then sintered to form an article comprising magnetocalorically active material for use in magnetic heat exchange. The magnetocaloric properties of the sintered samples are tested to determine if the use of a binder and solvent and the use of fluidized bed granulation affect the magnetocaloric properties.

The granules are packed in iron foil and gettered before the debinding and sintering heat treatments. The debinding temperature is 300° C. and the sinter temperature is 1120° C. The granules are heated under vacuum in 1½ hours to the debinding temperature and held that the debinding temperature 300° C. for 4 hours. Afterwards, the temperature is raised in 7 hours under vacuum to the sintering temperature, held for 3 hours at the sintering temperature under vacuum and additionally for one hour at the sintering temperature in argon. Afterwards the granule's are cooled to 1050° C. in 4 hours and held at 1050° C. for 4 hours under argon to homogonize the samples. The samples are then cooled quickly under compressed air to room temperature.

The samples were found to have a carbon uptake of 0.04 weight percent to 0.06 weight percent and an oxygen uptake of 0.15% to 0.3 weight percent. These values correspond substantially to those obtained during the investigation of suitable binders.

The sintered granules are hydrogenated by heating the granules in 2 hours under argon to 500° C. and held for one hour at 500° C. Afterwards, the atmosphere is changed to hydrogen and the samples cooled to room temperature in 8 hours and held under hydrogen for 24 hours. The granules are not found to disintegrate after the hydrogenation treatment.

Figure 11A:
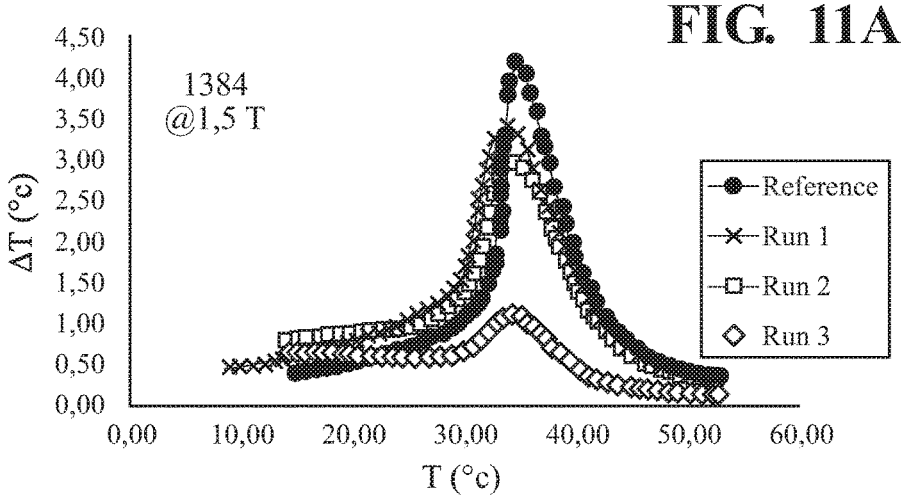
FIGS. 11A-11C illustrate graphs of the adiabatic temperature change (MCE) of sintered samples fabricated using fluidized bed granulisation.
Figure 11B:
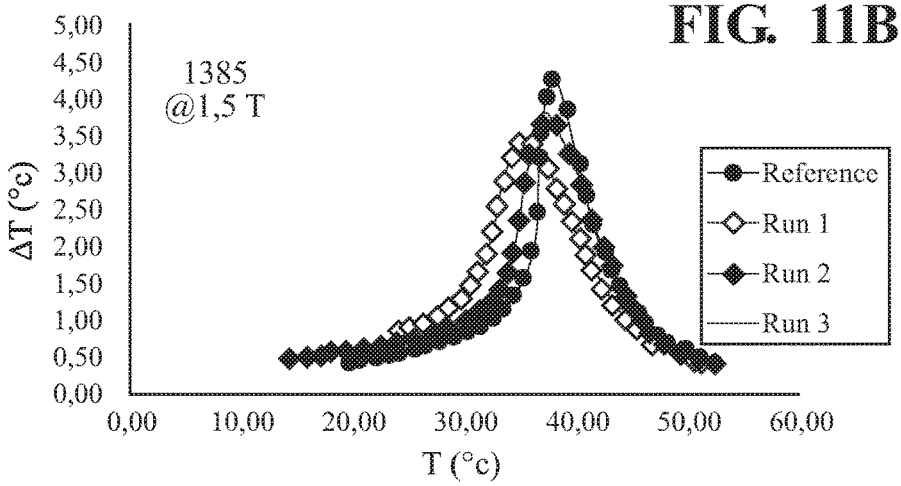
Figure 11C:
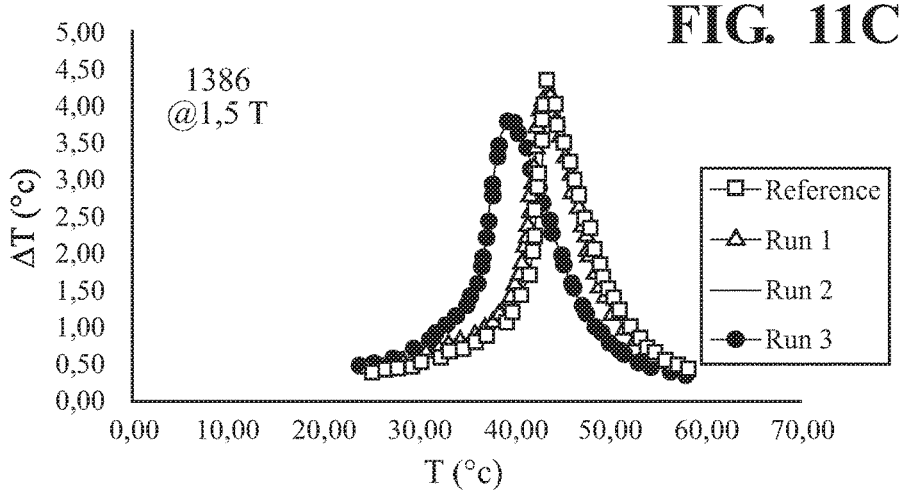
Figure 12A:
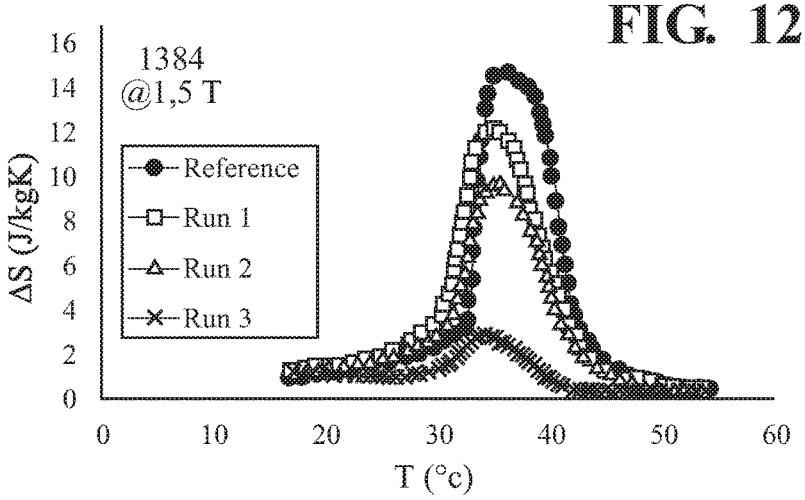
FIGS. 12A-12C illustrate graphs of entropy change of sintered samples fabricated using fluidized bed granulisation.
Figure 12B:
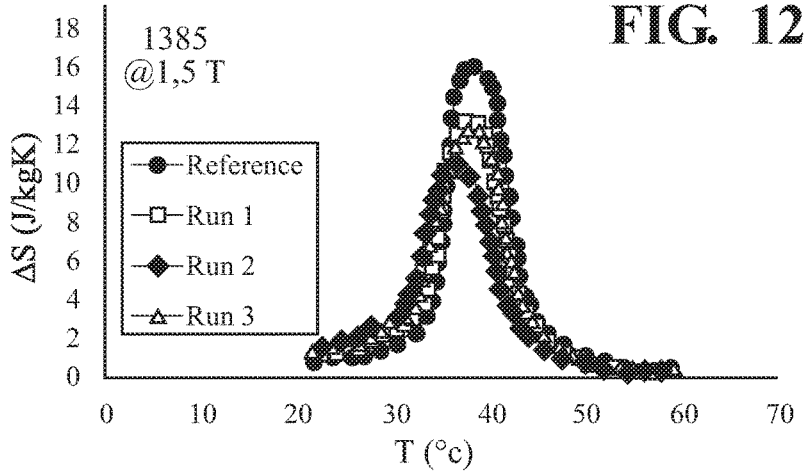
Figure 12C:
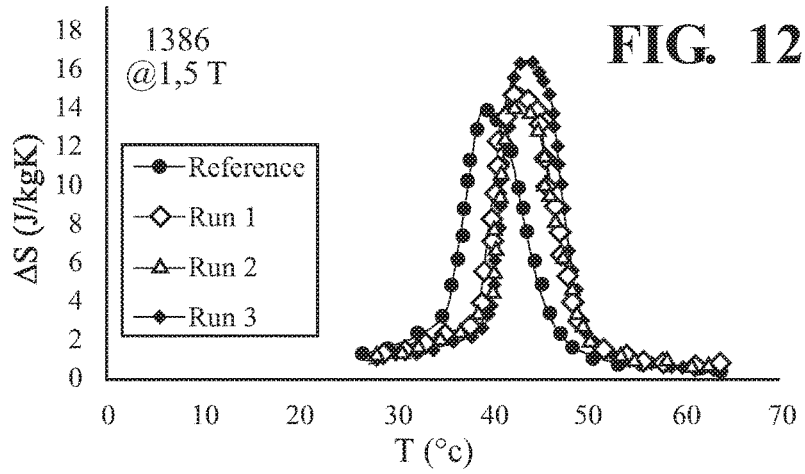

The magnetocaloric properties of the samples are investigated. FIG. 11 illustrates the diagrams of the adiabatic temperature change and FIG. 12 illustrates diagrams of the entropy change for the samples. The results are also summarized in table 5.

The values of the adiabatic temperature change and entropy change for granules fabricated in the first run are comparable to those of the reference sample fabricated by powder metal metallurgical techniques without using a binder.

TABLE 5

| @ 1.5T | 1384 Run 1 | 1384 Run 2 | 1384 Run 3 | 1385 Run 1 | 1385 Run 2 | 1385 Run 3 | 1386 Run 1 | 1386 Run 2 | 1386 Run 3 |
|---|---|---|---|---|---|---|---|---|---|
| ρ (g/cm$^3$) | 6.81 | 6.59 | 6.92 | 6.91 | 6.8 | 6.45 | 6.94 | 6.99 | 7.07 |
| Nominal $T_c$ (° C.) | | 30 | | | 35 | | | 40 | |
| $T_{Peak}$ (° C.) | 34.9 | 35.4 | 34.2 | 38.5 | 36.4 | 36.6 | 44.4 | 44.9 | 40.8 |
| ΔT (° C.) | 3.4 | 2.9 | 1.3 | 3.7 | 3.4 | 3.3 | 4.2 | 3.8 | 3.7 |
| ΔT Ref. (° C.) | | 4.32 | | | 4.36 | | | 4.35 | |
| ΔS (J/KgK) | 12.2 | 9.8 | 2.9 | 13 | 11 | 11.3 | 14.9 | 14.3 | 13.7 |
| ΔS Ref. (J/KgK) | | 14.7 | | | 15.9 | | | 16.2 | |
| $T_{Peak}$ (° C.) | 35 | 35.4 | 33.9 | 37.8 | 36.6 | 36.5 | 42.9 | 43.3 | 40 |
| α-Fe (wt. %) | 3.7 | 4.7 | 5.4 | 3.8 | 3.3 | 3.8 | 6.2 | 4.7 | 5.3 |

In a further set of experiments, starting materials for fluid bed granulisation of 1.5 kg of powder having a composition of 2.54 weight percent neodymium, 4.24 weight percent silicon, 15.95 weight percent lanthanum, 0.15 weight % cobalt, 3.61 weight percent manganese, 73.25 weight percent iron, 0.013 weight percent carbon, 0.21 weight percent oxygen and 0.028 weight percent nitrogen, 1 kg methyl ethyl ketone and two weight percent poly (propylene carbonate) (PPC) binder are prepared. After fluid bed granulisation, 80% of the granules produced have a diameter between 1000 μm and 1600 The granules can be considered as a composite body or brown body including a powder and a binder.

Granules or spherical composite bodies having a diameter of 1.2 to 1.5 mm are plastically deformed by pressing between an aluminum block and an annealed copper plate by applying a force of around 10N to 50N. The plastically deformed spherical granules may have disc shape. The temperature of the aluminum block, granule and copper plate is adjusted in order to plastically deform the composite bodies at different temperatures.

At a temperature of 23° C., the applied pressure caused the composite bodies to fracture. The temperature of 23° C. lies under the glass transition temperature of the poly (propylene carbonate) binder which is around 40° C. At a temperature of around 40° C., deformation of the composite bodies is observed. As the ratio of the diameter to the thickness of the resulting particles became greater than 1.5, cracks were formed which in some cases lead to fracture.

At a temperature of around 45° C., the composite bodies can be deformed such that a ratio of diameter to thickness of around 2 can be produced without cracks appearing. At a temperature of 50° C., composite bodies having a diameter of around 2.25 mm and a thickness of 0.75 mm can be produced, which corresponds to a ratio of the long to the short direction around 3. At a temperature of 60° c., which is around 20K higher than the glass transition temperature of the binder, plastically deformed disc shaped composite bodies with a diameter of around 2.45 mm and a thickness of 0.6 mm can be produced without cracking from a spherical particle having a diameter of between 1.2 to 1.5 mm.

This demonstrates that at temperatures above the glass transition temperature of the binder, for example 20K above the glass transition temperature of the binder, the composite bodies may be plastically deformed to an extent that after plastic deformation the composite body may have a first dimension $d_1$ which is at least 1.5 times a second dimension $d_2$, i.e. $d_1 > 1.5 \times d_2$.

In a further experiment, a similar powder to the previous experiment having a particle size of around 6 μm is mixed with 2 to 8 weight percent of a poly (propylene carbonate) binder which was dissolved in methyl ethyl ketone. The solvent is removed by drying. The resulting composite body including the powder and binder was plastically deformed in a twin screw extruder including a gap between the screws of around 12 mm at a temperature of 100° C. to form cylinder shaped rods having a diameter of around 1 mm. The rods were rounded at a temperature of 130° C. for 5 minutes in a spheronizer. The rods having an initial length of several millimeters are formed into several shorter cylinder shaped portions. The movement in the spheronizer rounds the corners of the cylinder shaped portions to form ellipsoid particles having a diameter of around 1 mm and a length of between 1 to 4 mm. The plastic deformation may be performed under inert conditions, for example under argon or nitrogen. The extruder and the spheronizer may be placed in a glove box filled with argon to avoid oxidation of the powders at the elevated temperatures.

The plastically deformed granules or composite bodies may be given a debinding and sintering treatment as discussed above resulting in essentially the same magnetocaloric properties as without the plastically deformation.

The invention claimed is:

1. A method of fabricating an article for magnetic heat exchange, comprising:

plastically deforming a composite body comprising a binder having a glass transition temperature TG and a powder comprising a magnetocalorically active phase or elements in amounts suitable to produce a magnetocalorically active phase such that at least one dimension of the composite body changes in length by at least 10%, wherein the binder comprises a polypropylene carbonate, and the magnetocalorically active phase comprises $La_{1-a}R_a(Fe_{1-x-y}T_yM_x)_{13}H_zC_b$ wherein M is Si and, optionally, Al, T is one or more of the elements from the group consisting of Mn, Co, Ni, Ti, V and Cr and R is one or more of the elements from the group consisting of Ce, Nd, Y and Pr, wherein $0 \le a \le 0.5$, $0.05 \le x \le 0.2$, $0.003 \le y \le 0.2$, $0 \le z \le 3$ and $0 \le b \le 1.5$.

2. The method according to claim 1, wherein the composite body is plastically deformed such that an elongated form is produced having a first dimension that is at least 1.5 times greater than a second dimension.

3. The method according to claim 1, wherein the composite body is plastically deformed such that an ellipsoid form is produced having a long axis that is at least 1.5 times greater than a shortest axis.

4. The method according to claim 1, wherein the plastically deforming the composite body comprises plastically deforming the composite body at a temperature T which is above the glass transition temperature TG of the binder.

5. The method according to claim 4, wherein T>TG+20K.

6. The method according to claim 1, wherein the plastically deforming the composite body comprises plastically deforming the composite body by rolling.

7. The method according to claim 6, wherein the rolling comprises passing the composite body between two rolls rotating in opposing directions.

8. The method according to claim 6, wherein the rolling comprises passing the composite body between two rolls rotating with differing speeds.

9. The method according to claim 1, wherein the plastically deforming the composite body comprises pressing a roller against a band, the surfaces of the roller and the band moving at substantially the same speed.

10. The method according to claim 1, wherein the plastically deforming the composite body comprises pressing a roller against a band, the surfaces of the roller and the band moving at differing speeds.

11. The method according to claim 1, wherein the composite body has a substantially cylindrical shape and the plastically deforming the composite body comprises treating the composite body in a spheronizer.

12. The method according to claim 1, wherein the plastically deforming the composite body comprises plastically deforming the composite body in an inert atmosphere.

13. The method according to claim 1, wherein the composite body comprises 0.1 weight percent to 10 weight percent binder.

14. The method according to claim 13, wherein the composite body comprises 0.5 weight percent to 4 weight percent binder.

15. The method according to claim 1, wherein the binder has a decomposition temperature of less than 300° C.

16. The method according to claim 15, wherein the binder has a decomposition temperature of less than 200° C.

17. The method according to claim 1, further comprising removing the binder from the composite body to form a green body, sintering the green body and producing an article for magnetic heat exchange.

18. The method according to claim 17, wherein the removing the binder is carried out at a temperature of less than 400° C.

19. The method according to claim 17, wherein the removing the binder is carried out in at least one of the group consisting of a noble gas, a hydrogen-containing atmosphere and a vacuum.

20. The method according to claim 17, wherein the removing the binder is carried out for 30 minutes to 20 hours.

21. The method according to claim 17, wherein at least 90% by weight of the binder is removed.

22. The method according to claim 21, wherein more than 95% by weight of the binder is removed.

23. The method according to claim 17, wherein the sintering is carried out at a temperature between 900° C. and 1200° C.

24. The method according to claim 23, wherein the sintering is carried out at a temperature between 1050° C. and 1150° C.

25. The method according to claim 17, wherein the sintering is carried out in a noble gas, a hydrogen containing atmosphere or a vacuum.

26. The method according to claim 17, wherein the green body for a total sintering time trot, wherein the green body is sintere in vacuum for $0.95t_{tot}$ to $0.75t_{tot}$ and subsequently in a noble gas or hydrogen-containing atmosphere for $0.05t_{tot}$ to $0.25t_{tot}$.

27. The method according to claim 20, wherein the removing the binder is carried out for 2 hours to 6 hours.

* * * * *